United States Patent [19]

Holzgruber

[11] 4,097,269

[45] Jun. 27, 1978

[54] PROCESS OF DESULFURIZING LIQUID MELTS

[75] Inventor: Wolfgang Holzgruber, Bruck an der Mur, Austria

[73] Assignee: INTECO Internationale Technische Beratung Gesellschaft m.b.H., Bruck an der Mur, Austria

[21] Appl. No.: 753,017

[22] Filed: Dec. 21, 1976

Related U.S. Application Data

[63] Continuation of Ser. No. 645,326, Dec. 30, 1975, abandoned.

[30] Foreign Application Priority Data

Jan. 14, 1975 Austria ..... 245/75
Feb. 10, 1975 Austria ..... 993/75

[51] Int. Cl.[2] ..... C21C 7/02
[52] U.S. Cl. ..... 75/58; 75/53
[58] Field of Search ..... 75/53, 58

[56] References Cited

U.S. PATENT DOCUMENTS 2,847,301 8/1958 Shaw ..... 75/58
3,716,352 2/1973 Ooi ..... 75/58
3,748,121 7/1973 Atterbury ..... 75/58

*Primary Examiner*—Peter D. Rosenberg
*Attorney, Agent, or Firm*—Toren, McGeady and Stanger

[57] ABSTRACT

A method for the rapid desulfurization of steel melts having oxygen available for reaction of less than 0.01% wherein the temperature of the melt is raised above 1500° C, and a desulfurizing slag is injected into the melt using a non-oxidizing carrier gas. The slag is in a finely divided state and is specially prepared by mixing calcium oxide, calcium fluoride and aluminum oxide with silicane dioxide and heavy metal oxides, melting the mixture and cooling the melt to prefuse the slag. Thereafter, the prefused slag is comminuted into the finely divided state. This slag has a liquidous temperature such that the particles thereof become liquid at a temperature at least 150° C below that of the steel melt and the particles are sufficiently small such that they become liquid immediately on contacting the melt. The process is advantageous in that it provides more rapid desulfurization and more complete desulfurization than prior art techniques.

10 Claims, No Drawings

PROCESS OF DESULFURIZING LIQUID MELTS

This is a Continuation of application Serial No. 645,326, filed December 30, 1975 now abandoned.

DESCRIPTION OF THE INVENTION

The melting of high-quality steels has been done till this day predominantly in basic-lined electric-arc furnaces.

Consequently, it is justified to use the further processing and functional qualities as well as the production cost of the steels for judging the standards of the melting installations with regard to technology and economy. It is doubtlessly desirable to improve these standards economically, e.g. by possibilities to reduce melting times, and technically, e.g. by increasing the cleanliness of steel essential for its processing and functional qualities.

The characteristics of steel cleanliness are, for instance, the S and P contents whose maximum admissible amounts are generally fixed by standard regulations, as well as are the percentages of trace elements, e.g. Pb, Sb, Sn, and the hydrogen and nitrogen contents, the amount, kind, shape and distribution of non-metallic inclusions.

The melting in electric-arc furnaces occurs substantially by means of three consecutive process steps for which the general names are melting, oxidizing and refining.

After melting the metallic charge, generally consisting mainly of scrap, the oxidizing period follows in the course of which it is intended, by means of an oxidizing slag, to achieve mainly a decarburization and dephosphorization of the steel bath and, to a smaller extent, a desulfurization of the same. After removal of the oxidizing slag, the refining period is beginning whose main task is the removal of too high a sulfur content. The sulfur in the electric-arc furnace mainly comes from the scrap, and the sulfur content of its metal parts is even increased by the sulfur content of oil residues on chips, of varnishings and coatings, adhering rubber particles and the like. Dependent on the scrap quality the sulfur content after melt down may be between 0.03 to 0.15%.

The maximum admissible S content in high-quality steels is generally about 0.025% and is frequently even still lower, often amounting to a maximum of 0.015, or even only to 0.010%.

Consequently, the effective removal of the sulfur is of extreme importance; it is achieved in the course of the refining period by means of a highly basic lime-fluorspar slag which, after removal of the oxidizing slag, is applied to the steel bath.

According to the assumption that the sulfur in the steel bath is dissolved as ferric sulfide [FeS] reacting with the lime in the slag (CaO) the reaction formula for the desulfurization is $$[FeS] + (CaO) = (FeO) + (CaS).$$

Thus, the desulfurization occurs at the phase interface steel bath - slag leading to the reaction products (CaS) and (FeO) being absorbed by the slag. Considering the constant of equilibrium K for this reaction and considering the respective activity a of the reaction participants, the desulfurization, i.e. the forming of (CaS), occurs according to the relation $$a(CaS) = \frac{1}{K} \cdot \frac{a\,[FeS] \cdot a\,(CaO)}{a\,(FeO)}$$

Thus, at a certain FeS percentage in the steel bath, the more CaS will be developing, the higher the value for a (CaO) and the lower the value for a (FeO) is. For an effective desulfurization, consequently, the lime percentage in the slag has to be sufficiently high. Wheresoever, the inconvenient FeO percentage is kept as low as possible by adding reduction agents, such as carbon in the form of graphite or crushed electrodes, Si or Al powder, whereby CO, $SiO_2$ or $Al_2O_3$ are developing as well as metallic Fe.

The desulfurization reaction occurring at the phase interface steel bath — slag, however, has as its prerequisite that the sulfur from the steel bath and the lime from the slag be currently transported onto this phase interface and the developing reaction products, above all the CaS, removed to the slag. Thus, the time required for the desulfurization is the shorter the more extended the reaction interface and the quicker the transport in and out of the reaction participants are. Owing to the fact, however, that during the refining period the agitation of the bath is only slow, this transport in and out is permitted to occur only relatively slowly. Moreover, the size of the reaction interface at only slow bath agitation is practically predetermined by the size and shape of the furnace. For these reasons the expenditure of time for an effective reduction of sulfur requires a relatively high share of the total melting time. It has to be added still that the desulfurization reaction may begin only after a reactive slag is obtained which, however, has to be produced only after the removal of the oxidizing slag. This is done by addition of lime, fluorspar and silica into the furnace, by liquefaction of these slag forming constituents by means of the electric-arc energy, and by also adding reduction agents in order to reduce the 5 to 8% portion of heavy metal oxide, mainly of FeO, to values below 5%. Only after the finalizing of these processes which, dependent on the size of the furnace, generally takes between 15 to 20 minutes, a reactive refining slag is obtained which is effective for desulfurization. At this time, addition of alloying elements may also begin which are more readily oxidizable than iron, such as Si, Mn or Cr. For achieving sufficiently low S values the expiration of 30 to 60, in extreme cases even 70, minutes will have to be expected so that the total of the refining period will last from 45 to 90 minutes, i.e. about ¼ to ⅓ of the total melting time.

These circumstances induced a number of suggestions whose objective was an improvement of the mixing conditions of slag and metal for desulfurization, starting with the assumption that the absorption capacity of refining slags with a poor FeO content generally is not exhausted at the end of the refining period because the reaction occurs slowly owing to the long transport path within the steel bath and within the slag and to the relatively small reaction interface, and because the achieving of the reaction equilibrium cannot be awaited for time reasons.

One of these suggestions is to agitate the bath by means of stirring coils mainly in large electric-arc furnaces in order to shorten the reaction paths and to increase the reaction interface. At the same time homogenization of the melt is to be achieved thereby and batching avoided which occurs during the refining period mainly of alloyed steels and which is liable to cause ingotism. A further disadvantage of this phenomenon is the fact that the value of the analysis of a sample taken at the end of the refining period becomes problematic. Consequently, by the use of stirring coils the economically interesting advantage is achieved, among others, — in addition to a shortening of the refining period — that the adding amount of expensive alloying elements may be calculated very closely because uncertainties by separation in the melt are eliminated.

Considerably more effective were, with regard to desulfurization, the slag reaction processes serving mainly for the desulfurization of heats from open-hearth furnaces. Thereby, highly basic lime fluorspar slag, melted in a special slag melting furnace, was brought into a ladle in liquid state, and into it the heat completed as to alloy contents and temperature was tapped, and the close intermixing and swirlingthrough between steel and slag achieved an effective desulfurization. Heats from acid-lined induction furnaces were treated with such slags, too, whereby, in addition to a desulfurization, particularly an extraction of inclusions and suspensions from the steel was also achieved and, thus, a considerable improvement of quality.

The disadvantages of these processes are mainly the necessity to operate a special, relatively small and, thus, unprofitably working slag melting furnace whose working manner has to be adapted to the heat cycle in the melt shop. The result of these requirements is the fact that the application of these processes is not justifyable in most cases for economic reasons. Moreover, the difficulty has to be considered that after the treatment a checking of the same and, possibly, a correction of the heat as to composition and temperature is no longer possible if no ladle vacuum-heating equipment is at disposal. The cost for it, however, are only justified if they can be compensated or overcompensated by shortening the heat cycle, by quality improvements, by increasing the accuracy of the heat composition, and the like. In reality, however, such conditions exist only in high-quality steel production and there, too, only in special cases.

According to a special form of the slag reaction process, heats from an electric-arc furnace may be desulfurized in the ladle by adding, prior to tapping, a deoxiding slag in desintegrated state to the ladle. By mixing the liquid steel with this slag powder an extensive desulfurization is achieved. The required slag powder is obtained from the refining slags customary with all electric-arc furnaces which at heavy metal oxide contents below 5% desintegrate to powder during cooling below about 300° C.

Experience shows that by this process a maximum reduction of the sulfur content down to 0.025% is possible which, however, in many cases is not sufficient. Moreover, for this treatment slags with greatly differing compositions have to be applied so that an estimate of their effect carries great uncertainties.

The subject of the present invention is to avoid the disadvantages of these known processes without having to give up their advantages.

An increased purity of steel, particularly a lowest S content and a good homogenization of the melts, can be achieved according to the invention after relatively short treatment times in that, after the removal of the oxidizing slag and after predeoxidation, for most extensive possible reduction of the oxygen dissolved in the steel, a prefused highly basic slag is injected by means of a non-oxidizing carrier gas. The melting point of this highly basic slag lies at least 150° C below the temperature of the steel bath. Thus, the conventional refining period is substantially replaced by the injection operation taking only about 5 to 20 minutes.

The prefused slag consists of 10 to 60% CaO, 10 to 70% $CaFe_2$, 0 to 40% $Al_2O_3$, max. 20% $SiO_2$ and is to contain not more than a maximum of 5% of heavy metal oxides, such as Fe-, Mn-, and Cr-oxides. Preferably, the slag consists of 35 to 50% CaO, 25 to 40% $CaF_2$, 15 to 25% $Al_2O_3$, 5 to 15% $SiO_2$ and of a maximum of 2% heavy metal oxides. The liquidus temperatures of such slags, for the purpose of the invention, are to lie between 1250° and 1350° C so that in treating liquid steel melts at temperatures above 1500° C the immediate melting of the slag is safeguarded. This is the prerequisite of an effective desulfurization. Preferably, the liquidus temperature of the slag lies about 300° to 400° C below the temperature of the liquid steel.

The grain size of the slag particles to be injected is to be smaller than 5 mm, i.e. smaller than a globule with a 5 mm diameter or smaller than a body whose relevant globule diameter is smaller than 5 mm. Preferably, the grain size is to be 1 to 3 mm. If the grain size is too small, for instance that of dust particles, the injected particles may be transported off again, together with the carrier gas. If the particles are too big, there is the danger that they will not melt sufficiently quickly and will float up in a still solid state to the slag layer developing upon the steel bath.

The slag amount to be injected is generally 0.5 to 2%, preferably about 1% of the heat weight. It is evident that the amount depends on the necessary or desired rate of desulfurization.

The injecting into the steel bath may be done by a selfdissolving injector tube as customary with oxygen injections.

The carrier gas to be used for the transportation of the slag particles must not have an oxidizing effect so that neither air nor oxygen are to be taken into consideration owing to the fact that prior to injecting, predeoxidation of the heat is to be carried out. As a carrier gas mainly technically pure argon or nitrogen may be used. Mixtures of these gases, too, are to be used as a carrier gas. Possibly, hydrocarbons, such as natural gas, may be taken.

The required pressure of the carrier gas amounts to at least 6 atm for the method according to the invention, preferably 8 to 12 atm are used.

Together with the slag additional reduction agents, such as ferrosilicon powder, aluminum powder, magnesium powder and the like, may be injected in order to remove residues of heavy metal oxides and thereby to increase the effectiveness of the slag. In this case the carrier gas may be air, too, since the latter, in the presence of sufficient percentages of reduction agents, does not have an oxidizing effect on the steel bath.

By means of the predeoxidation, necessary prior to the injecting, which in a conventional manner may be done with carbon, ferromanganese silicon, ferrosilicon, or aluminum, a Si content in the melt of at least 0.1% or an Al content of at least 0.02% is to be set individually or together.

The addition of alloying elements more readily liable to oxidize than iron, may occur either directly after the injecting of the slag, or also directly prior to the injecting after completed predeoxidation. The latter method has the advantage that during the injecting operation the melting and the homogeneous distribution of the alloying additions are promoted by the vigorous bath agitation.

Subsequently to the injecting it may be advantageous at times to afterblow during 5 to 15 minutes simply with the carrier gas, without any addition of slag, in order to achieve as most complete as possible a separation of inclusions and suspensions from the steel, to further eliminate hydrogen and nitrogen and to improve the homogenization of the heat regarding alloying components and temperature. The time limit of this measure is important owing to the fact that less than 5 and more than 15 minutes have proved to be without additional effects or improvements respectively.

The process step by which a highly basic lime fluorspar slag is injected in fine-grained state into the steel bath by means of a non-oxidizing carrier gas is, however, not only of interest for the production of high-purity steels in basiclined electric-arc furnaces, but may be used quite generally as desulfurizing process as far as the heat can be brought into a state suitable for this treatment.

In steel production in many cases one does without demanding extreme steel purity simply because of economic reasons. Nevertheless, the problem of desulfurization is often of great importance and, thus, the demand exists doubtlessly for a technically and operationally easily controllable desulfurizing process incurring the lowest possible additional cost.

Desulfurizing deoxidized steel melts with at least 1530° C in a ladle after covering it with a basic and FeO-less slag by injecting fine-grained Ca, CaSi or $CaC_2$ with a neutral carrier gas is well known. The desulfurizing agent is offered thereby in the form of calcium vapor bubbles which are at disposal for the reaction within the steel bath for a short time only because of the high vapor pressure of the calcium. For an improvement of the utilization of the calcium vapor the immersion lance is to be immersed more than 2 m deep. The still only poor utilization of calcium for desulfurization justifies the assumption that layers of CaS or CaO form around the calcium vapor bubbles thus hindering the matter exchange bubblebath.

This difficulty does not exist if the desulfurizing agent develops as a consequence of applying the quickly melting slag particles in the form of slag droplets because the CaS developing at the phase interface slag droplet — bath is immediately dissolved in the slag. Consequently, the slag droplets are at disposal in the steel bath up to the limit of the sulfur absorption ability particularly because of their comparatively much longer residue time in the steel bath.

In accordance to other suggestions the desulfurization is to occur by injecting fine-grained lime with hydrocarbons, such as natural gas, or in case of electric-arc furnaces with argon, too. The effect of this measure, however, was not able to meet expectations owing to the fact that to a considerable part the injected particles did not melt in time, and entered, therefore, the slag in a solid state and, thus, without effect.

An effective desulfurization may be expected only if the difference between the temperature of the heat and the liquidus temperature of the desulfurizing agent is sufficiently big and the oxygen content in the steel bath, whose effect is best defined by its oxygen activity, is the lowest possible.

The requirement regarding liquidus temperature of the desulfurizing agent is doubtlessly met by lime fluorspar slags used for producing steels of high purity in basic-lined electric-arc furnaces and prefused, if the temperature of the heat is at least 1500° C, preferably more than 1600° C.

The question of admissible oxygen activity was subject of thorough investigations. They had as a result the fact that an effective desulfurization may be expected only if at the beginning of the considered desulfurizing treatment the oxygen activity of the steel bath is less than 0.01%.

This requirement can be met already after melt down, e.g. in remelt heats for which an oxidizing period may be done without. Generally, however, it will have to be enforced by deoxidation treatments which, nevertheless, must not lead either to an undesired rephosphorization or to an inadmissible temperature loss of the heat.

Thus, the subject of the invention is a process of the desulfirizing liquid steel melts whose temperature is higher than 1500° C, preferably higher than 1600° C, and whose oxygen activity is less than 0.01%, by injecting a desulfurizing agent in fine-grained state by means of a non-oxidizing carrier gas, and the invention is a process wherein a prefused, highly basic lime fluorspar slag, whose liquidus temperature is at least 150° C lower than that of the steel bath and whose composition lies within the range of 10 to 60% CaO, 10 to 70% $CaF_2$, 0 to 40% $Al_2O_3$, max. 20% $SiO_2$ and max. 5% heavy metal oxides, is injected as desulfurizing agent into the steel bath.

In addition to the already described advantages of the inventional process and its special embodiments, attention is called to the fact that by the injecting of the carrier gas the effect of a good mixing and swirling-through of the steel bath is obtained by which a fine dispersion of the injected slag particles is caused. Therewith, favorable conditions to obtain a high surface to volume ratio of the liquified particles and, thus, promoting desulfurization are achieved. Moreover, by the mixing of the bath the separation of inclusions and suspensions and the elimination of hydrogen and nitrogen are considerably facilitated. These effects may be increased additionally by afterblowing. During the conventional refining period, however, hydrogen and nitrogen are absorbed.

With regard to profitableness, too, the process of the invention is of considerable interest. The use of stirring coils for the mixing of the steel bath can also be renounced for, instance, in large electric-arc furnaces. The time savings compared to the conventional refining period effects a shortening of the tap to tap time and, thus, an improvement of the utilization rate of the furnace. Owing to the fact that during the conventional refining period the steel bath is already at pouring temperature, the furnace lining underlies particularly intensive wear. Therefore, a shortening of the refining period results in a considerable reduction of lining consumption per ton of steel.

Compared to these economic advantages, the comparatively increased cost for the prefusing and the crushing of the slag as well as for the injecting of the latter are insignificant.

However, for a further improvement of the profitableness in steel production in a basic-lined electric-arc furnace it is possible to do without the removal of the oxidizing slag and the predeoxidation in the furnace, to tap the heat immedeately after the oxidizing period into the ladle, and, after the conventional ladel deoxidation, to carry out the desulfurizing treatment during or immediately after tapping.

Above all, in such cases this working method is recommendable where no extreme requirements concerning steel purity are set, or where the required oxidizing effect is not very high, as e.g. in remelt heats. For built-up heats in which the additions of alloying elements, oxidizing more readily than iron, are carried through during the refining period, however, this working method will not prove satisfactory in general.

In open-hearth furnace operation there exists the difficulty that fuel gases have usually an oxidizing effect upon the slag and, therewith, upon the steel bath, so that the conditions for a satisfactory desulfurization in the furnace are insufficient. As a consequence, the desulfurization is carried out after tapping of the completed and conventionally predeoxidized heat in the ladle. It is useful to perform an additional ladle deoxidation during tapping in order to obtain the required low oxygen activity.

In basic oxygen steel making (BOF) desulfurization is not the main problem owing to the fact that there the charge comprises substantially liquid pig iron which has already undergone a desulfurizing treatment prior to steel production. Moreover, a certain sulfur percentage is removed during oxygen injection. Nevertheless, if in exceptional cases a still more extensive desulfurization is required, only a treatment after tapping in the ladle can be taken into consideration. Owing to the here comparatively very short tap to tap times, an additional slag operation, e.g. deslagging prior to tapping, and an injection of slag particles after predeoxidation would have particularly disturbing effects.

With induction furnaces only a relatively cold and, thus, unreactive slag is at disposal by means of which neither an oxidizing period nor a refining period can be carried out effectively. These are furnaces used exclusively for producing remelt heats. The slag existing after melt down of the charge is practically not reacting with the steel bath and, consequently, is neither in a position to influence the desulfurizing treatment, let alone to disturbe it.

Under such conditions, which may be expected always where induction furnaces are used, however, with other furnaces only at the utmost in exceptional cases, a desulfurizing treatment is possible within the furnace too, which, suitably, occurs subsequently to predeoxidation.

This fundamental possibility, however, does not exclude ladle treatment to be preferred nevertheless, if it is interesting for economic reasons and if no subsequent control is required as to the effect of the treatment, and possibly no correction of the heat composition. Possibilities, however, for controlling and correcting are existent during ladle treatments only in cases where by reason of a ladle vacuum-heating equipment a sufficiently long remaining time of the heat in the ladle is possible. For small ladles, as they are used for heats from induction furnaces, such equipment is not to be taken into consideration.

Subsequently to an inventional desulfurizing treatment in the ladle it may be of advantage to afterblow carrier gas without slag addition. In cases, however, where the ladle containing the heat is placed in a degassing plant, the afterblowing is performed preferably only during the degassing operation. This may increase the effect of the afterblowing considerably, mainly with regard to the reduction of hydrogen and nitrogen. Thus, the desulfurizing treatment may occur either prior to placing the ladle with the heat into the degassing plant or only within the degassing plant if the temperature of the heat is still sufficiently high or has been increased to the required level by auxiliary heating. After the desulfurizing treatment, the pressure in the installation is reduced to values of e.g. 0.5 to 5 Torr for the degassing of the heat. The afterblowing occurs suitably only after this low pressure has been reached.

For desulfurization in induction furnaces or in degassing plants, in which a forced bath agitation is achieved by means of inductive stirring, the afterblowing may be renounced.

Further details concerning the useful application of the inventional process and the advantages of the same are revealed in the following embodiments.

EMBODIMENT 1

In a 20 t basic electric-arc furnace an alloy of about 0.28% C, 0.50% Mn, 0.25% Si, 0.85% Cr, 0.30% Mo, 1.65% Ni and max. 0.02% S had to be melted for the production of a big forging. In the course of the process, after melt down of the metallic charge consisting completely of scrap, the conventional oxidizing period was carried through during which the alloying with nickel and molybdenum took place. At the end of the oxidizing period, the C content was 0.21%, the Mn content 0.22%, the Cr content 0.18%, the P content 0.014%, and the S content 0.053%. The heat had a temperature of 1650° C. After removal of the oxidizing slag, for predeoxidation 10 kg of aluminum and, subsequently, 86 kg of ferromanganese silicon with 65% Mn, 25% Si, balance substantially iron, were added whereby an Al content of 0.025%, Mn content of 0.50% and a Si content of 0.11% were obtained. Immediately subsequently to the predeoxidation, 200 kg of ferrochromium with 67% chromium and 7.1% C were added which led to an increase of the Cr content up to 0.85% and of the C content to 0.28%. These additions occurring within 5 minutes caused a temperature drop of the heat down to 1620° C.

For the purpose of desulfurization, 250 kg of prefused slag were injected now into the heat said slag having about 40% CaO, 30% $CaF_2$, 20% $Al_2O_3$ and 10% $SiO_2$, having a grain size of 1 to 2 mm, and additionally still 30 kg of ferrosilicon with 70% Si. As a carrier gas technically pure argon with a pressure of 8 atm was used; the injection time was 10 minutes. For injecting a tube with an inside diameter of 12.7 mm (½ inch) was used. 3.5 $m^3$argon were consumed per minute. Subsequently to the injecting of the slag and the ferrosilicon, afterblowing was carried out with argon at a flow rate of 2 $m^3$/min.

During the entire injecting time the electrodes of the furnace were operating with 2700 kW. The sample, drawn after the injection and the afterblowing, had a composition of 0.25% C, 0.51% Mn, 0.19% Si, 0.015% P, 0.016% S, 0.83% Cr, 0.31% Mo, 1.62% Ni and 0.015% Al. The hydrogen content at the time of sampling was 3.7 ppm. This value, however, is of theoretical interest only in the present case, because the pouring of the ingot occurred under vacuum. The temperature at the time of sampling was 1640° C and thus corresponded to the intended tapping temperature.

In the ladle 17 kg of ferrosilicon and 50 kg of a conventional desulfurizing agent, to be obtained in trade, were still added to the heat whereby the S content could still further be reduced to 0.009%.

The forging, processed from the subsequently vacuum-cast ingot, had good ultrasonic test results and during processing proved to be free of slag inclusions and stringers.

By applying the inventional process it was possible to reduce the otherwise conventional refining period, usually taking at least 70 minutes with this steel and this furnace, to 28 minutes.

EMBODIMENT 2

In a basic 15 t electric-arc furnace a hot-work die steel had to be melted for the production of bar steel having about 0.32% C, 2.4% Cr, 4.3% W, 0.6% V and max. 0.015% S.

The charge consisted of unalloyed and alloyed scrap having low P contents and containing in relation to the melt weight 1.04% Cr and 1.1% W, and for this reason 630 kg of ferrotungsten with 82% W and 325 kg of ferrochromium with 65% Cr and 5% C were added.

After melt down of this charge, the heat contained 0.29% C, 0.06% Si, 0.26% Mn, 2.35% Cr, 4.45% W and 0.15% V. The P content was 0.016% and the S content was 0.047%. The temperature of the heat at the time of sampling was 1530° C. The oxygen activity was measured and had a value of 0.005%, thus meeting the conditions for the desulfurizing treatment according to the invention. Subsequently, 95 kg of ferrovanadium with 71% V were added and the temperature increased up to 1620° C. After having reached this temperature, during tapping, 32 kg of ferrosilicon with 70% Si were added into the ladle. The S content inspected directly prior to tapping had a value of 0.032%. The desulfurizing treatment now performed in the ladle consisted of injecting 150 kg of slag with about 30% CaO, 58% $CaF_2$, 8% $Al_2O_3$ and 4% $SiO_2$ with a grain size of 1 to 2 mm. Nitrogen was used as carrier gas with a pressure of 8 atm; the injecting time was 5 min. and the nitrogen consumption was 4 $m^3$/min. Subsequently, nitrogen was afterblown during 5 minutes at a flow rate of 2 $m^3$/min. The injection tube had an inside diameter of 12.7 mm (½ inch). The final sample after this treatment had a V content of 0.62% and an S content of 0.012%. The heat was cast to square ingots of about 1 t weight at a temperature of 1570° C.

From power on to tapping, the heat was in the furnace for 155 minutes, 130 of which were consumed for melting the charge. Without applying the process according to the invention, a refining time of 30 to 40 minutes would have been required with this steel and this type of furnace in order to achieve less than 0.015% S. Thus, the saving of furnace time amounts to about 20%. For carrying through the desulfurizing treatment in the furnace the saving of furnace time would have amounted to about 15% only.

EMBODIMENT 3

In a natural gas fired 50 t open-hearth furnace a die steel had to be melted with about 0.55% C, 0.60% Mn, 0.25% Si, 0.7% Cr, 1.7% Ni, 0.3% Mo, 0.1% V and max. 0.015% S in compliance with the AISI Standard 6 F2 for the processing of forged bar steel.

The charge consisted of unalloyed and alloyed scrap and of pig iron.

After the melt down of the charge the heat contained 0.92% C, 0.43% Mn, 0.02% Si, 0.26% Cr, 0.95% Ni, 0.15% Mo, 0.02% V, 0.038% P and 0.072% S; the bath temperature was 1510° C. After melt down, during 95 minutes, the furnace was operated at a heat input of 12 $\times 10^6$ B.T.U./h and, thereby, the C content was reduced to 0.52%, the Mn content to 0.21%, the Cr content to 0.21%, the P content to 0.012% and the S content to 0.042%; after this time, the temperature of the heat was 1640° C. During the oxidizing period the additions of nickeloxide-sinter and molybdeniumoxide-sinter were made, increasing the nickel content to 1.72% and the Mo content to 0.29%. After sampling, at the end of the oxidizing period, additional 300 kg of ferromanganesesilicon, with 66% Mn and 22% Si, and 385 kg of ferrochromium, with 65% Cr and 5.6% C, were added to the heat. After these additions, the bath temperature was 1630° C and the oxygen activity was less than 0.01%. The tapping occurred at this temperature. During tapping, the ladle deoxidation was performed by additions of 40 kg of ferrosilicon, with 70% Si, and of 10 kg of aluminum. The temperature of the heat in the ladle was 1600° C. At this time, the steel had a hydrogen content of 6.4 ppm. Subsequently, the ladle containing the heat was placed in a ladle degassing plant with re-heating and, therein, the liquid steel was heated up to 1630° C by means of electric-arc heating. Subsequently, for the desulfurization, 600 kg of slag, with about 40% CaO, 40% $CaF_2$, 10% $Al_2O_3$ and 10% $SiO_2$, with a grain size of 1 to 2 mm, having admixed 60 kg of finely ground ferrosilicon as reduction agent, were injected by technically pure argon. The argon pressure was 8 atm, the argon flow rate 7 $m^3$/min., and the injection time was 10 minutes. The tube used for injecting had an inside diameter of 19.1 mm (¾ inch).

Subsequently to this injecting, the pressure in the degassing plant was lowered to 2 Torr and after reaching this pressure, 50 l argon per minute were afterblown during 10 minutes.

After this treatment, the heat had a temperature of 1600° C, a hydrogen content of 1.8 ppm, and, after inspection of the S content, it was cast in molds to 5 t polygonal ingots. The final sampling resulted in 0.56% C, 0.58% Mn, 0.22% Si, 0.71% Cr, 0.31% Mo, 1.72% Ni, 0.11% V, 0.015% P and 0.011% S.

In this case a saving of furnace time is not achieved. The advantage of applying the inventional process, however, lies in the only possibility of an effective desulfurization which, with this type of furnace, could not be obtained otherwise or merely by tolerating other disadvantages, such as those of the known slag reaction process.

EMBODIMENT 4

In a conventional 2 t induction furnace a steel had to be melted with max. 0.07% C, max. 2% Mn, max. 1% Si, 25% Cr, 25% Ni, 2.3% Mo, max. 0.045% P, max. 0.015% S and with a Ti content which was to amount to at least ten times the C content. From this steel bar steel was to be processed by rough forge and finish-rolling.

The charge consisted of alloyed revert scrap and of ferro alloys with low carbon contents. The alloy contents in the charge were so calculated that, with the exception of the titanium, the proposed contents were to be achieved after melting.

After the melt down, the temperature of the heat was increased to 1620° C. At this time, the C content was, 0.045% and the S content was 0.032%. Subsequently, 15 kg of ferrosilicon with 70% Si were added to the heat and, subsequently, the desulfurizing treatment was carried through. The latter consisted of injecting 40 kg of slag with about 40% CaO, 30% $CaF_2$, 20% $Al_2O_3$ and 10% $SiO_2$ with a grain size of 1 to 3 mm. Technically pure argon was used as carrier gas with a pressure of 6 atm. The argon flow rate was 0.8 $m^3/m$; the injection time was 10 minutes.

The injection tube had an inside diameter of 6.4 mm (¼ inch). During injecting, the furnace was turned off so that after this treatment the bath temperature had only 1570° C. A sample taken thereafter resulted in a value of 0.011% S. The furnace was then turned on again in order to increase the bath temperature. In this case afterblowing could be renounced since the desired bath agitation will develop as a consequence of the inductive heating. The tapping was performed after reaching a bath temperature of 1600° C, and during tapping into the ladle, 22 kg of ferrotitanium with 65% Ti having a grain size of max. 5 mm were added to the strean. Finally, the heat was cast into molds of 450 kg square ingots. The final sample showed 0.045% C, 1.65% Mn, 0.67% Si, 25.3% Cr, 24.8% Ni, 2.18% Mo, 0.52% Ti, 0.026% P and 0.011% S. In this case, too, no saving of furnace time is achieved, however, there is the possibility of an intensive desulfurization which, in the induction furnace, cannot be performed in a conventional manner because of the cold and unreactive slag.

What is claimed is:

1. A process characterized by rapid desulfurization of steel melts whose oxygen available for reaction is less than 0.01% comprising:

raising the temperature of the melt above 1500° C;

injecting a desulfurizing slag into the melt by means of a non-oxidizing carrier gas;

said slag being in a finely divided state and having been prepared by mixing, on a percent weight basis, 10 to 60% CaO, 10 to 70% $CaF_2$, 0 to 40% $Al_2O_3$, a maximum of 20% $SiO_2$ and a maximum of 5% heavy metal oxides, melting the mixture and then cooling the melt to prepare a prefused slag and then comminuting the prefused slag into the finely divided state, said slag having a liquidus temperature such that the particles thereof become liquid at a temperature at least 150° C below that of the steel melt and the particles of the slag being sufficiently small such that they become liquid substantially immediately on contacting the melt;

the injection being carried out in a manner to produce a fine dispersion of the slag particles in the melt.

2. The process of claim 1 wherein the slag is in a fine-grained state and comprises 35 to 50% CaO, 25 to 40% $CaF_2$, 15 to 25% $Al_2O_3$, 5 to 15% $SiO_2$, and a maximum of 2% heavy metal oxides or iron, manganese, or chromium whose liquidus temperature lies in the range between 1250° to 1350° C.

3. The process of claim 1 wherein the grain size of the slag is a maximum of 5 mm.

4. The process of claim 1 in which the amount of slag injected into the steel bath is 0.5 to 2% of the heat weight.

5. The process of claim 1 in which, together with the slag, additional reduction agents, selected from the group consisting of ferrosilicon powder, aluminum powder, and magnesium powder are injected into the steel bath.

6. The process of claim 1 in which the carrier gas loaded with the slag is injected into the steel bath at a pressure of at least 6 atm.

7. The process of claim 1 in which subsequently to injecting the slag, the injection operation is continued for 5 to 15 minutes with unloaded carrier gas.

8. The process of claim 1 in which the slag is injected into a steel bath in a basic-lined electric-arc furnace after removal of the oxidizing slag and after a predeoxidation step.

9. The process of claim 1 in which the slag is injected into a steel bath contained in a melting furnace underneath a practically non-reactive slag.

10. The process of claim 1 in which the ladle containing the liquid steel, either prior to or after the completed desulfurizing treatment is degassed with the carrier gas used for the desulfurizing treatment for 5 to 15 minutes.

* * * * *